US010190322B2

(12) United States Patent
Haas

(10) Patent No.: US 10,190,322 B2
(45) Date of Patent: Jan. 29, 2019

(54) INTERLOCKING ARCH TILE

(71) Applicant: Thomas C. Haas, St. Helena, CA (US)

(72) Inventor: Thomas C. Haas, St. Helena, CA (US)

( * ) Notice: Subject to any disclaimer, the term of this patent is extended or adjusted under 35 U.S.C. 154(b) by 0 days.

(21) Appl. No.: 15/231,976

(22) Filed: Aug. 9, 2016

(65) Prior Publication Data

US 2017/0089079 A1 Mar. 30, 2017

Related U.S. Application Data

(60) Provisional application No. 62/284,436, filed on Sep. 29, 2015.

(51) Int. Cl.
*E04F 15/024* (2006.01)
*E04F 15/02* (2006.01)
*E04F 15/10* (2006.01)

(52) U.S. Cl.
CPC .. *E04F 15/02411* (2013.01); *E04F 15/02038* (2013.01); *E04F 15/105* (2013.01); *E04F 2201/022* (2013.01)

(58) Field of Classification Search
CPC ..... E04F 15/024; E04F 15/02405; E04F 15/02411; E04F 15/02183; E04F 15/02177; E04F 15/02022; E04F 15/02038; E04F 15/10; E04F 15/102; E04F 15/02
See application file for complete search history.

(56) References Cited

U.S. PATENT DOCUMENTS 4,387,130 A 6/1983 See
4,753,058 A * 6/1988 Ray, III ..... E04F 15/02429 52/789.1
5,031,368 A 7/1991 Matthews
5,074,085 A * 12/1991 Ueda ..... E04F 15/02476 248/916
5,118,547 A 6/1992 Chen
5,228,252 A * 7/1993 Nehls ..... E04F 15/02429 52/126.6
5,928,764 A 7/1999 Costi
6,519,902 B1 * 2/2003 Scissom ..... E04F 15/02458 52/126.4
7,516,587 B2 4/2009 Barlow
(Continued)

FOREIGN PATENT DOCUMENTS

EP 0524413 A1 1/1993

*Primary Examiner* — Jessica L Laux
(74) *Attorney, Agent, or Firm* — Thomas Schneck

(57) ABSTRACT

Tiles having a matrix of interconnected vaults on its underside surface provides space for flow of heated or conditioned air, passages for electrical service conduits and wiring, or passages for drainage. In particular, each tile may comprise a solid rigid body having a substantially planar upper surface and thickness substantially less than upper surface linear dimensions. The underside surface has a set of concavities forming a matrix of vaults bounded and interconnected by archways. Each archway is characterized by a rise dimension that is less than a span dimension. The matrix of vaults defines a set of pendentives at each vault corner whose load-bearing bases are all substantially coplanar with one another so as to contact a supporting subfloor. Edges of the tile body have corresponding alternating laterally projecting extensions and indentations for forming (with some desired leeway) mortise-and-tenon joints between adjacent tiles.

20 Claims, 7 Drawing Sheets

(56) References Cited

U.S. PATENT DOCUMENTS

| | | | | |
|---|---|---|---|---|
| 7,779,591 | B2 | 8/2010 | Becker et al. | |
| 7,900,416 | B1 | 3/2011 | Yokubison et al. | |
| 8,124,210 | B2 | 2/2012 | Kim | |
| 8,191,324 | B2 | 6/2012 | Wallin | |
| 8,215,077 | B1 | 7/2012 | Dreyer | |
| 8,225,566 | B2 * | 7/2012 | Prevost | E01C 13/08 52/177 |
| 8,397,466 | B2 | 3/2013 | Jenkins et al. | |
| 8,590,252 | B2 | 11/2013 | Cordeiro | |
| 8,640,403 | B2 | 2/2014 | Masanek, Jr. et al. | |
| 8,726,602 | B2 | 5/2014 | DeLong | |
| 8,806,831 | B1 | 8/2014 | Dreyer | |
| 8,815,370 | B2 | 8/2014 | Reichwein et al. | |
| 8,993,098 | B2 | 3/2015 | Masanek, Jr. et al. | |
| 2006/0070314 | A1 * | 4/2006 | Jenkins | E01C 13/045 52/177 |
| 2006/0265975 | A1 * | 11/2006 | Geffe | E04F 15/10 52/177 |
| 2007/0261317 | A1 * | 11/2007 | Moller, Jr. | E01C 5/20 52/78 |

* cited by examiner

INTERLOCKING ARCH TILE

CROSS-REFERENCE TO RELATED APPLICATION

This application claims priority under 35 U.S.C. 119(e) from prior U.S. provisional application No. 62/284,436, filed Sep. 29, 2015.

TECHNICAL FIELD

The present invention relates to finishing work for buildings, especially floors and related flooring materials, and more particularly relates to floor tiles.

BACKGROUND ART

Tiles made of various material (stone, ceramic, glass, polymers, etc.) have been used for a wide variety of purposes over many millennia, including in roofs, walls and floors. Those used for flooring must be able to durably support the weight of materials (furniture, boxes, etc.) and people walking on them without shifting or cracking. Improvements over the basic flat polygonal plate construction of floor tiles continue to be made, for example to provide interlocking features, adhesive-less installation, noise reduction and the like.

For example, U.S. Pat. No. 8,815,370 to Reichwein et al. describes a resilient floor tile whose backing has an array of annular projections with concave surfaces. The resilience of the array creates a vacuum in the blind passageways that increase friction with the underlying surface sufficiently to hold the tiles in place without need for adhesive.

U.S. Pat. No. 8,397,466 to Jenkins et al. describes a polymer tile for outdoor use with multi-level lattices that provide drainage from the top surface. It is also characterized by a loop and pin connector arrangement for interlocking the tiles together.

U.S. Pat. No. 8,124,210 to Kim describes a metal mosaic tile having concave parts on the back that mitigate noise or vibration while still being of high strength.

U.S. Pat. No. 5,031,368 to Matthews describes 'pliable' concrete tiles with a diagonal ridge with narrow inverted-V cross-sectional shape. This allows the tile to deform when pressure is applied so that the tile resists shear forces when used in construction on false floors.

SUMMARY DISCLOSURE

A tile having a matrix of interconnected vaults on its underside surface provides space for flow of heated or conditioned air, passages for electrical service conduits and wiring, or passages for drainage. In particular, the tile comprises a solid rigid body having a substantially planar upper surface and a thickness substantially less than upper surface linear (length and width) dimensions. The underside surface has a set of concavities forming a matrix of vaults bounded and interconnected by archways. Each archway is characterized by a rise dimension that is less than a span dimension. The matrix of vaults defines a set of pendentives at each vault corner whose load-bearing bases are all substantially coplanar with one another so as to contact a supporting subfloor. Edges of the tile body have corresponding alternating laterally projecting extensions and indentations for forming (with some desired leeway) mortise-and-tenon joints between adjacent tiles.

A tile flooring system comprises a plurality of such tiles interconnected over a subfloor. Archways at the respective edges of adjacent tiles are substantially aligned. Tiles buttress one another at adjacent corner and edge pendentive bases.

DETAILED DESCRIPTION

Definitions

Figure 1:
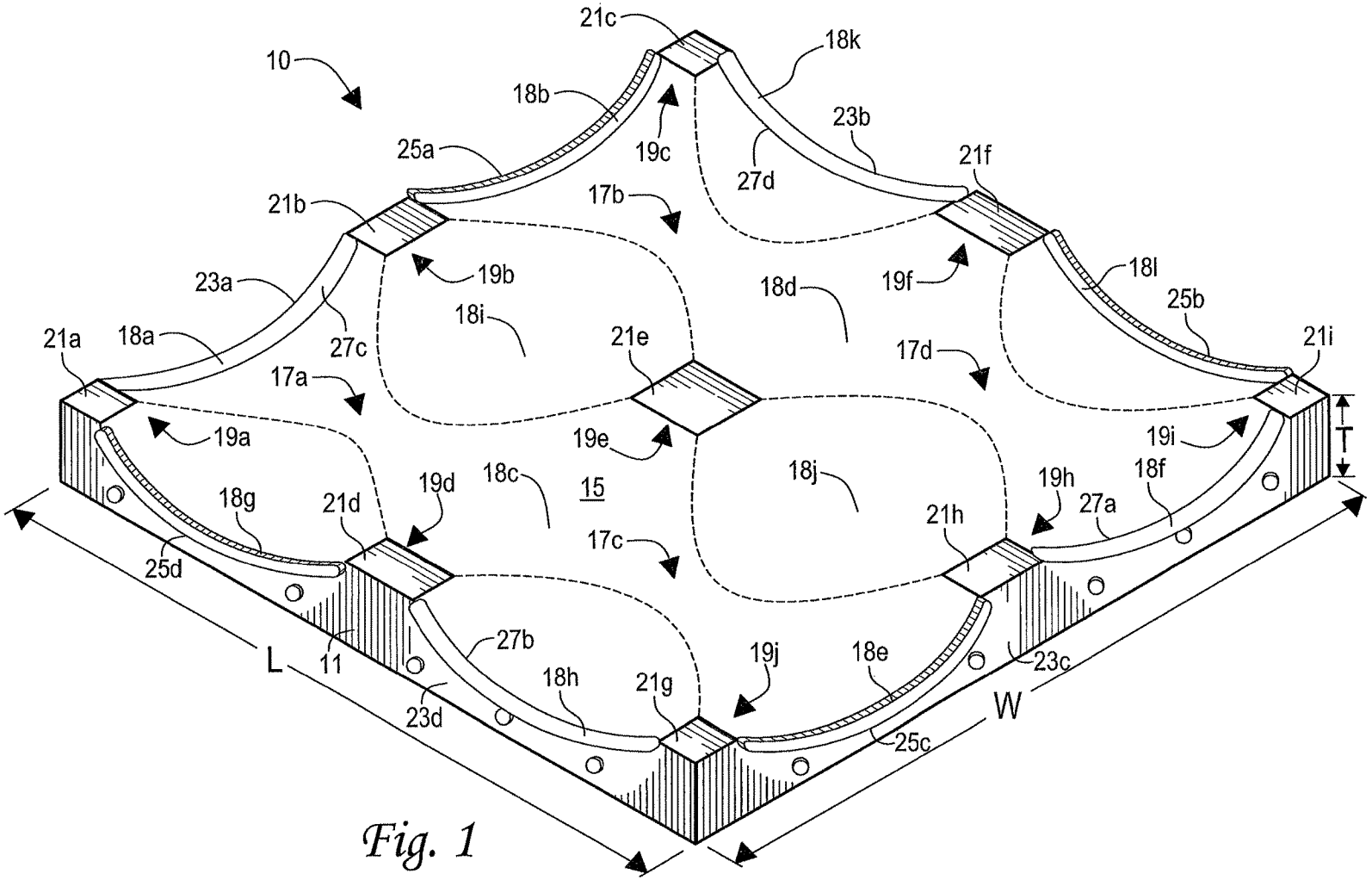
FIGS. 1 through 4 are respective perspective, bottom, inverted side and top plan views of a tile in accord with the present invention having a two-by-two matrix of vaults in its underside surface.
Figure 2:
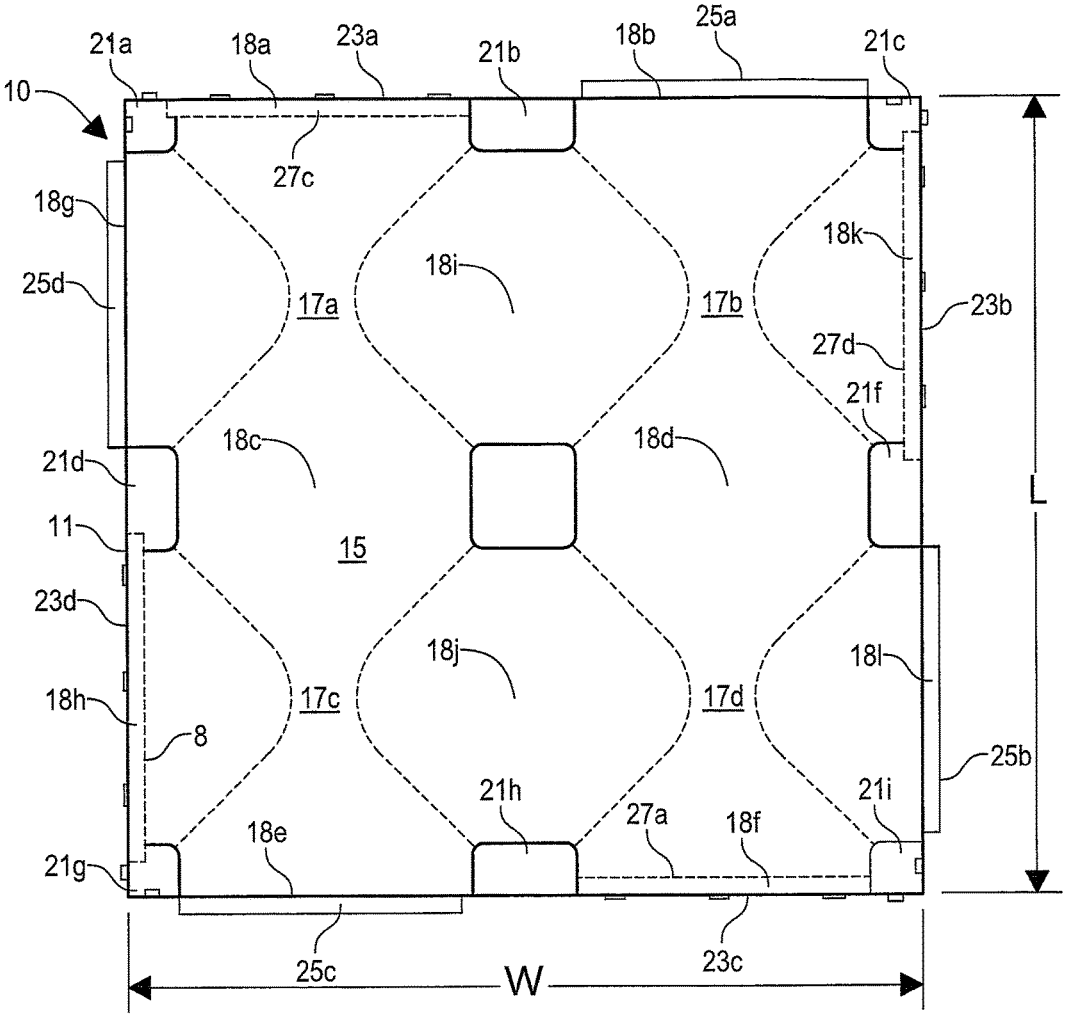
Figure 3:
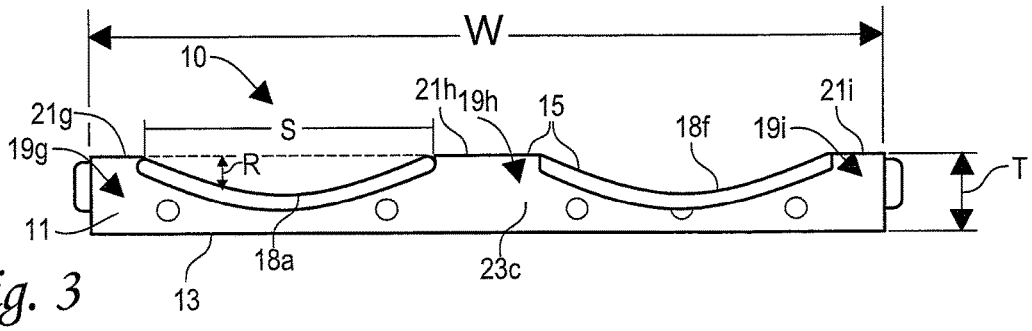
Figure 4:
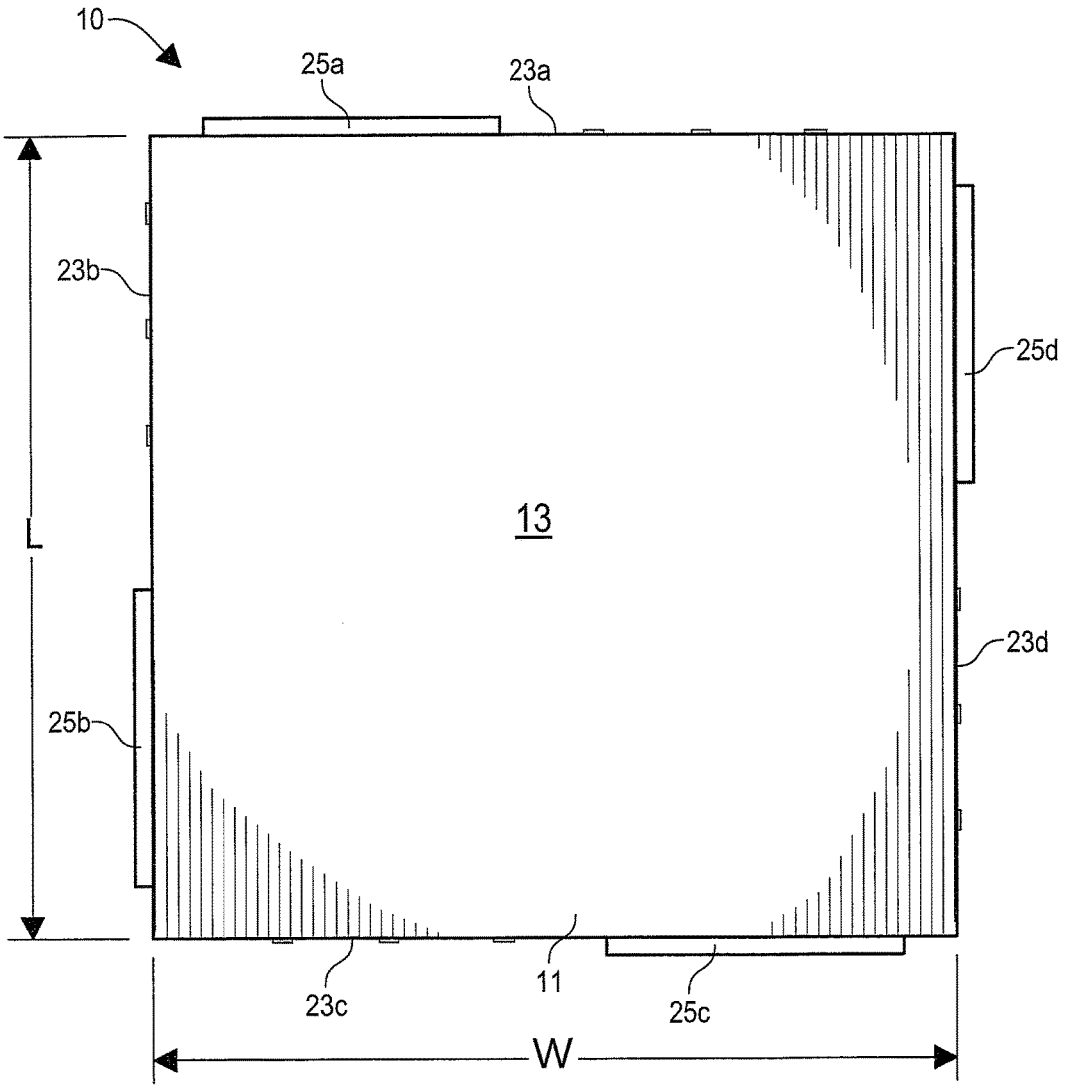

Arch: a curved structure that spans a space and resolves any downward stresses, into compressive stresses carried to its base. [Note: while ancient arches were normally constructed of multiple separate blocks (or voissoirs) capped by a keystone, each tile envisioned here comprises a single homogeneous solid body of material. But, the resolution of stresses, or arch action, from any loads applied to the top surface of a tile is substantially the same here.]

Vault: an arch extended into a third dimension; a continuous arch. (Often, this is contrasted with a dome, which is an arch revolved about a vertical axis. In the present application, the term vault can be generally used interchangeably for both. Both groin vaults and sail vaults or domes are envisioned as possible underside surface constructions.)

Groin vault: a vault formed from intersecting barrel vaults, with groin edges (or arrises) defined at the intersections.

Sail vault: also known as a sail dome; a vault or dome in the form like an upward-directed square sail that is pinned down at each corner, with four archways at the bottom.

Pendentive: a curved wedge-like segment tapering to a corner at the base of a dome or vault and receiving the weight and redirected load from the dome or vault. In the case of a sail vault, the pendentives are continuous extensions of the dome or vault down to their bases.

Thrust: any laterally outward directed component of forces at the base of an arch or vault that may need to be buttressed by laterally adjacent structures (e.g. another tile, or a wall). The amount of thrust depends in part on the shape of the arch or vault and the relationship between its respective span and rise dimensions, with wider spans and/or lower rises leading to generally greater thrusts.

With reference to FIGS. 1 through 4, a tile 10 is seen to be formed as a single homogeneous solid rigid body 11 having a substantially planar upper surface 13 and an underside surface 15 with a plurality of vaults 17*a*-17*d*. The thickness T of the tile body, measured from the top surface 13 to the bases 21*a*-21*i* of the pendentives 19*a*-19*i*, is substantially less than either linear dimension (width W or length L) of the tile upper surface 13. For example, the linear dimensions W and L may be at least 8 times (and preferably about 10 times) greater than the thickness T. The tile thickness at the pendentive bases may be 1 inch (2.5 cm), for example. In the preferred embodiment shown here, the tile

10 is a square tile where the width W is equal to the length L, e.g. both being 11⅝ inches (29.5 cm). However, rectangular tiles are also possible.

Tiles may be cast in an open or closed mold that is filled, for example, with a cementeous material having an admixture of glass fibers, antimicrobial formula, and colorant. Many alternative formulations can be used, included glazed or unglazed ceramic material that is subsequently fired. Even glass materials could be used. The top surface, while generally flat, may be embellished with a decorative or non-skid pattern.

The underside surface 15 has a plurality of concavities defining a matrix of vaults, in this case a two-by-two matrix of four vaults 17*a*-17*d*. These vaults can be groin vaults as seen here (the groins or arrises being indicated by the dashed, lines in FIGS. 1 and 2), or might also be sail vaults or domes, or another similar vault or dome form defined by the mold in which the tile is formed.

The matrix of vaults 17*a*-17*d* are bounded and interconnected by archways 18*a*-18*l* running in two directions (as in an x-axis direction and a perpendicular y-axis direction). Thus in this cross-arched vault or dome configuration, there are three sets of archways, 18*a*-18*b*, 18*c*-18*d*, and 18*e*-18*f* running parallel to each other in a first direction, and three other sets of archways, 18*g*-18*h*, 18*i*-18*j*, and 18*k*-18*l* running parallel to each other in a second direction perpendicular to the first direction. Archways 18*c*, 18*d*, 18*i* and 18*j* interconnect the four vaults 17*a*-17*d* to each other, while the other archways at the tile edges align with those of any adjacent tiles to connect with vaults of those adjacent tiles. Each archway 18*a*-18*l* preferably has a span S that is at least 8 times greater than its rise dimension R (see FIG. 3). For example, the span S might be 4.312 inches (10.95 cm) and the rise R might be 0.5 inch (1.27 cm) at the archways. The center of the vaults could be up to 0.625 inch (1.59 cm) above the bases, leaving a minimum thickness of the tile at the four vault center locations of 0.375 inch (0.95 cm) for 1-inch thick tiles.

The matrix of vaults 17*a*-17*d* defines a set of pendentives 19*a*-19*l*, including four at tile corners, 19*a*, 19*c*, 19*g* and 19*i*, four at tile edges, 19*b*, 19*d*, 19*f* and 19*h*, and one in the tile center, 19*e*. Each of these pendentives 19*a*-19*l* terminates at a corresponding base 21*a*-21*l*. These bases 21*a*-21*l* are substantially coplanar with one another so that they can all make contact with a supporting sub-floor, the bases of the pendentives being the load-bearing surface on the underside of the tiles. The bases 21*a*-21*l* may themselves have concave depressions deep enough to accept elastomeric materials for leveling, positioning and/or cushioning purposes.

The vaults span at least 75% of a linear dimension (W or L) across the underside surface, e.g. a total of 8⅝ inches (21.9 cm) of the 11⅝ inch (29.5 cm) square tile, and thereby leaving room, for example, for a 1.5 inch (3.8 cm) square center pendentive base 21*e*, 1.5 inch by 0.75 inch (3.8 cm by 1.9 cm) rectangular edge pendentive bases 21*b*, 21*d*, 21*f* and 21*h*, and 0.75 inch (1.9 cm) square corner pendentive bases 21*a*, 21*c*, 21*g* and 21*i*. Thus, the area of the pendentive bases from which stresses are transferred to the subfloor occupies at least 6.25% (and in the representative example, 6.66%) of the total tile area.

All of these example dimensions are representative, but could be varied across different embodiments according to the strength of the tile material, anticipated surface loads and the like. Likewise, the vault and archway shapes could be based upon catenary, hyperboloid, or ellipsoidal forms, as desired for a particular embodiment to effectively transfer the applied surface loads by arch action to the several pendentive bases and then to the subfloor. It should be noted that, as the span is much wider than the rise in these tile embodiments, the thrust from applied loads will be buttressed by adjacent tiles that resist laterally outward movement of tile edges.

Each side edge 23*a*-23*d* of the tile 10 typically has an approximately 4° draft so as to provide about a 0.125 inch (3 mm) gap that allows for the placement of grout or sealant material between adjacent tiles.

It is further contemplated that the arch tiles described herein would preferably include one or more interlocking features, specifically those that define mortise-and-tenon or tongue-and-groove type joints. In one such embodiment seen in FIGS. 1-4, each edge 23*a*-23*d* of the tile has corresponding alternating laterally projecting extensions 25*a*-25*d* and indentations 27*a*-27*d* that conform to the inner curves of the edge archways 18*a*, 18*b*, 18*e*, 18*f*, 18*g*, 18*h*, 18*k* and 18*l*. Each side of the tile 10 therefore has an extended curved form 25*a*-25*d* projecting from the archways 18*b*, 18*e*, 18*g* and 18*l*, and an indented or recessed curved form 27*a*-27*d* within the archways 18*a*, 18*f*, 18*h* and 18*k*. The exact curvatures of both the extensions and indentations depend upon the particular shape chosen for the vaults and their corresponding archways, but can be approximated as the arc of a circle of some specified diameter. The inside diameter of the extensions 25*a*-25*d* equal that of the correspond archway 18*b*, 18*e*, 18*g* and 18*l*, while the outer diameter of those same extensions may be approximately 0.188 inch (4.8 mm) greater. Likewise, those extensions may project laterally outward by approximately 0.188 inch (4.8 mm) from the tile edge. The outer diameter of the indentations 27*a*-27*d* may be approximately 0.200 inch (5.1 mm) greater than the diameter of corresponding archway 18*a*, 18*f*, 18*h* and 18*k*, and extend inward to a depth of 0.200 inch (5.1 mm). Alternatively, if desired, the indentations could extend all of the way through the archways and open into the respective vaults, in which case those archways could be viewed as simply being of 0.200 inch (5.1 mm) greater diameter than the other archways having the outward extensions. In either case, it can be seen that the indentations 27*a*-27*d* are of approximately 0.012 inch (0.3 mm) greater diameter and depth dimensions than the outer diameter and outward extent of the projections 25*a*-25*d*, thereby permitting ease of engagement when adjacent tiles are interconnected and a space that can be filled with grout or sealant material. Note that the existence of the extensions will keep any such grout or sealant from filling the archways themselves.

In another interlocking arrangement, each tile edge could have either a vertical slot within or a vertical node extending outward from the edge pendentives 19*b*, 19*d*, 19*f* and 19*h* and/or corner pendentives 19*a*, 19*c*, 19*g* and 19*i* that are arranged such that nodes on one tile fit into corresponding slots on an adjacent tile. This may be instead of or in addition to the curved extensions and indentations associated with the tile archways that were described above. The length, width and depth dimensions of slots should be slightly larger, e.g. by 0.050 inch (1.3 mm) than the corresponding length width and extension dimensions of the nodes, giving some leeway for installation.

Figure 5:
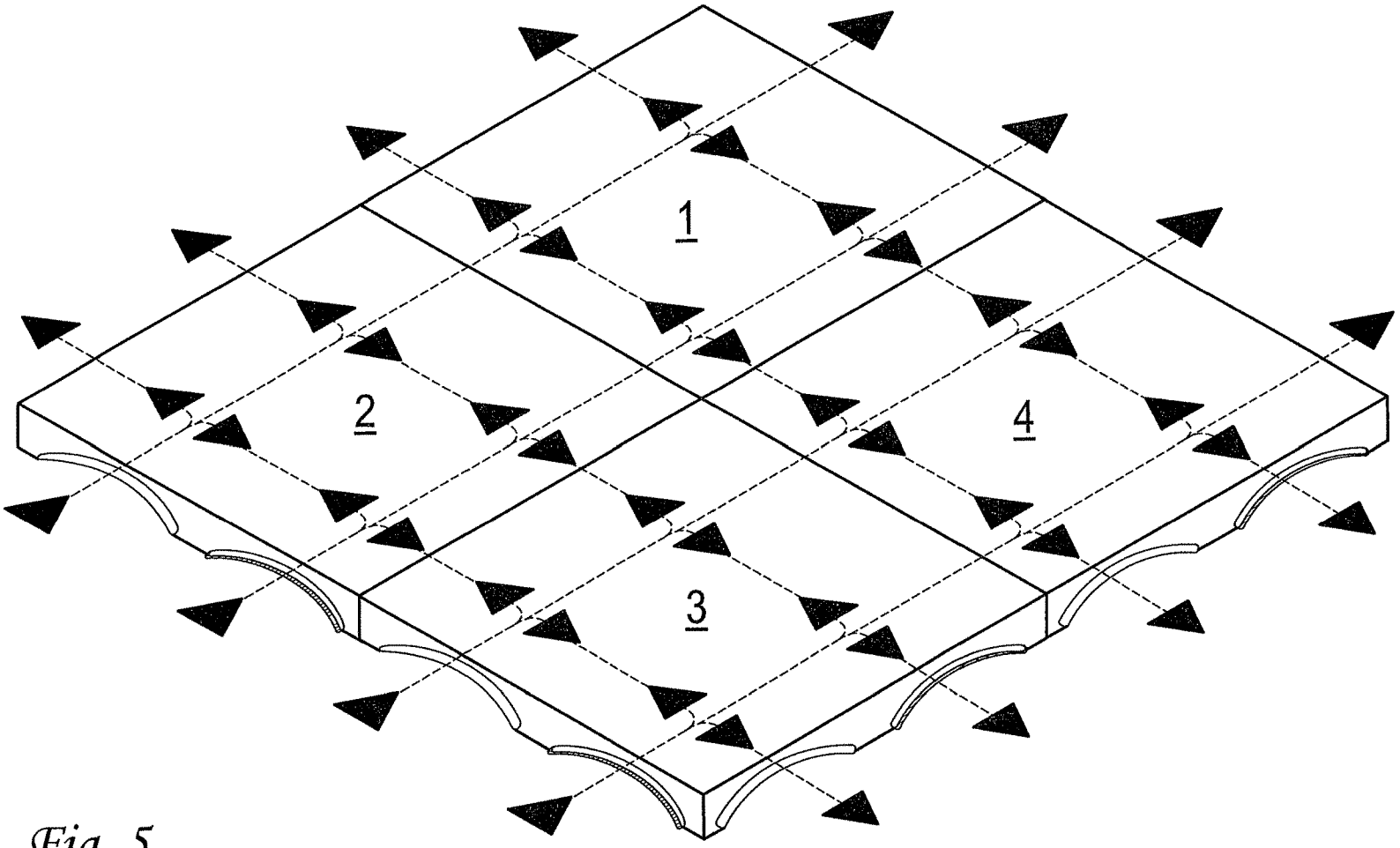
FIG. 5 is a top view of four such tiles, illustrating airflow between vaults.
Figure 6:
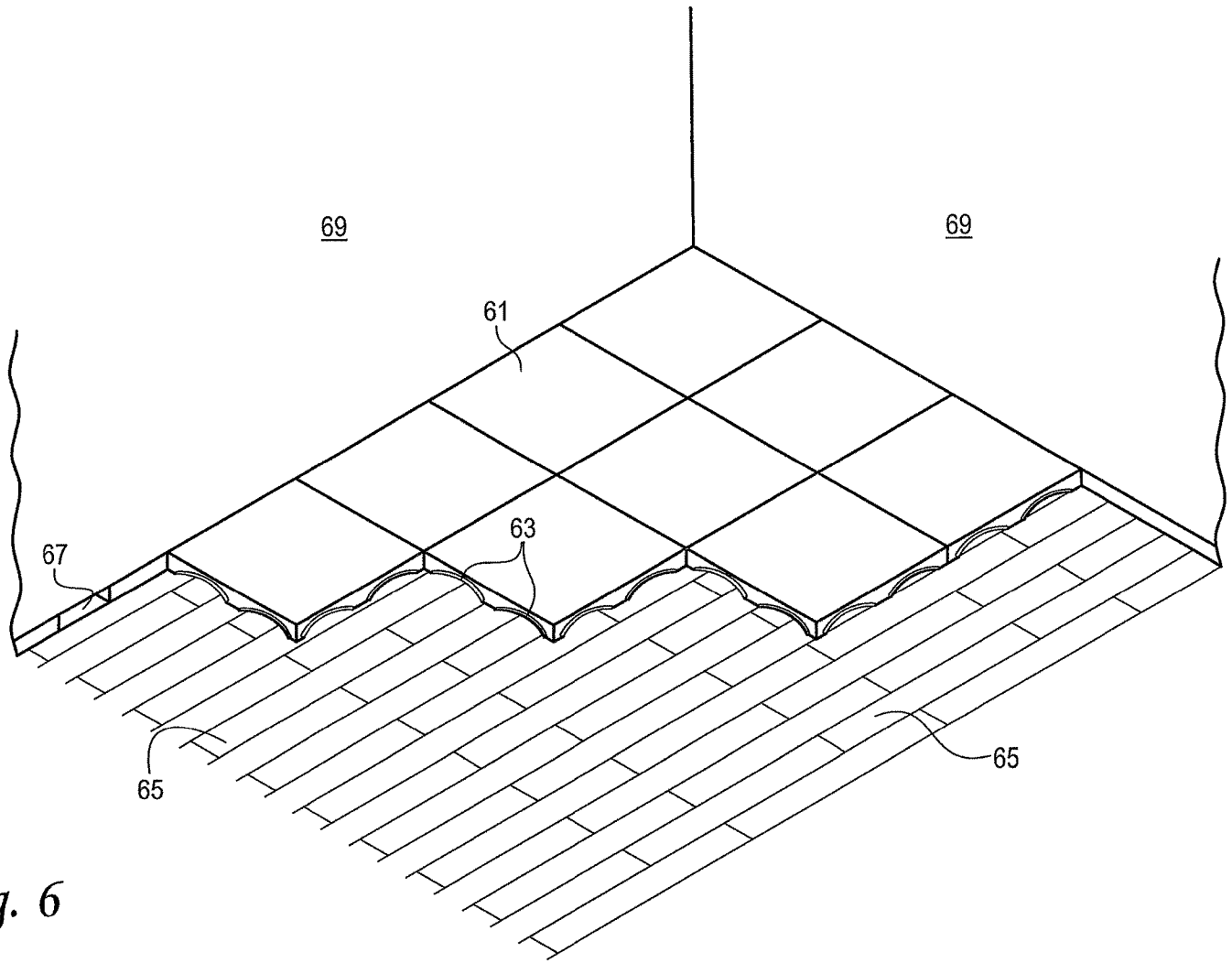
FIG. 6 is a perspective view of a room with tiles being laid over a subfloor in interconnected relation to one another.

With reference to FIGS. 5 and 6, arch-tiles like those just described allow heated or conditioned air to flow beneath the floor surface. In a two-by-two partial arrangement of floor tiles 1-4 shown in FIG. 5 and the larger arrangement of tiles 61 shown being installed in the perspective view of FIG. 6, the flow of air (represented by the dashed lines and arrows in FIG. 5) under the tiles can be in two dimensions between adjoining vault spaces 63, spreading laterally outward beginning from one or more air sources (e.g. from under the subfloor 65 through subfloor vents 67). This will result in radiant heating (in the winter) or distribution of cooling (in summer) through the floor itself. If desired, some edge portions or gaps between some adjoining tiles 61, or next to the walls 69, might be left unsealed to permit the conditioned air to flow into the room above the floor. Otherwise exit vents may also be provided in the subfloor.

These arch-tiles can overlay a subfloor or an existing or new floor surface. The arch-tiles can cover or hide loose wiring or electrical service conduits, which will run through the connecting vault-ways and from one tile to the next. This not only eliminates unsightly wires, but also improves safety by preventing tripping. Because such wires or conduits are located above sub-flooring, individual tiles could be carefully removed, (if any interlocking elements provided in the tiles are not especially deep) in order to gain access when needed to install additional wiring or repair existing wiring.

Figure 7:
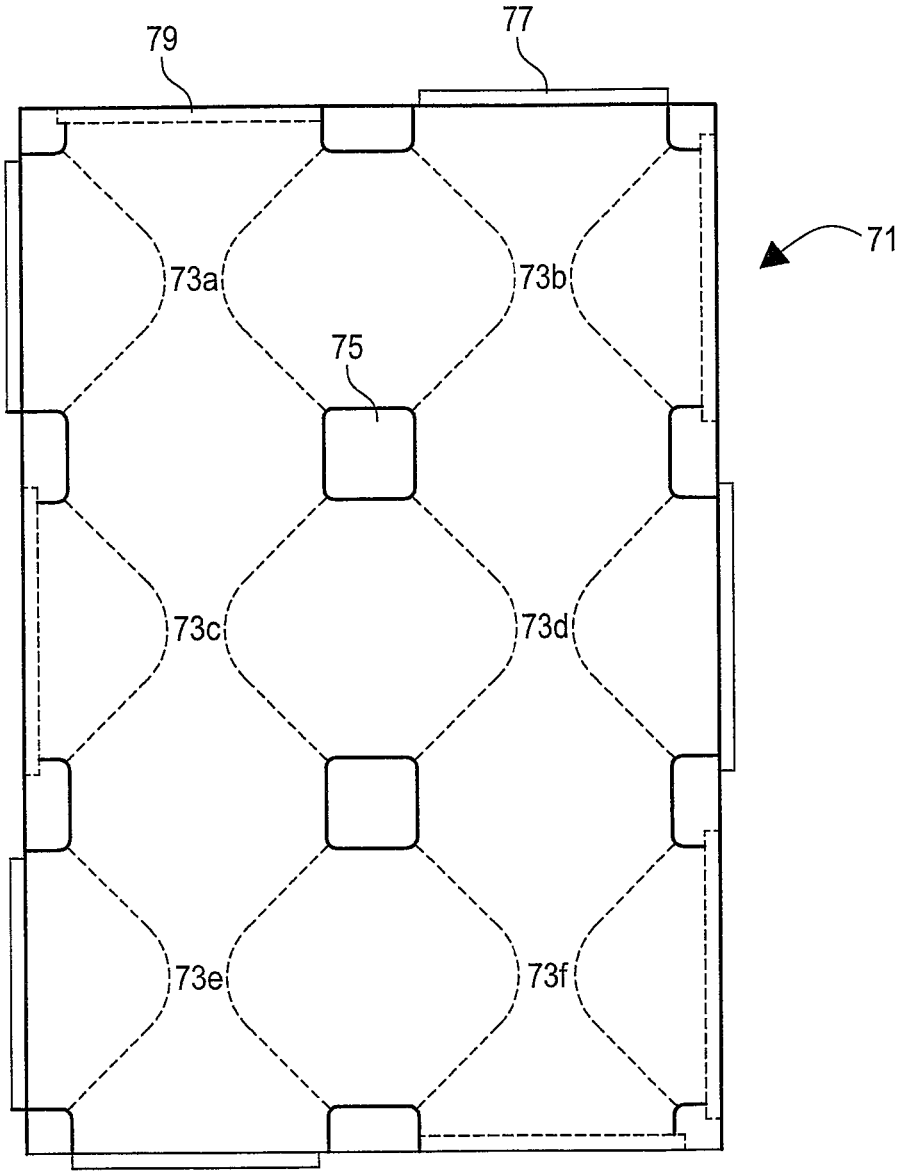
FIGS. 7 and 8 are two alternative embodiments of tiles having respective 2-by-3 and 3-by-3 matrices of vaults.
Figure 8:
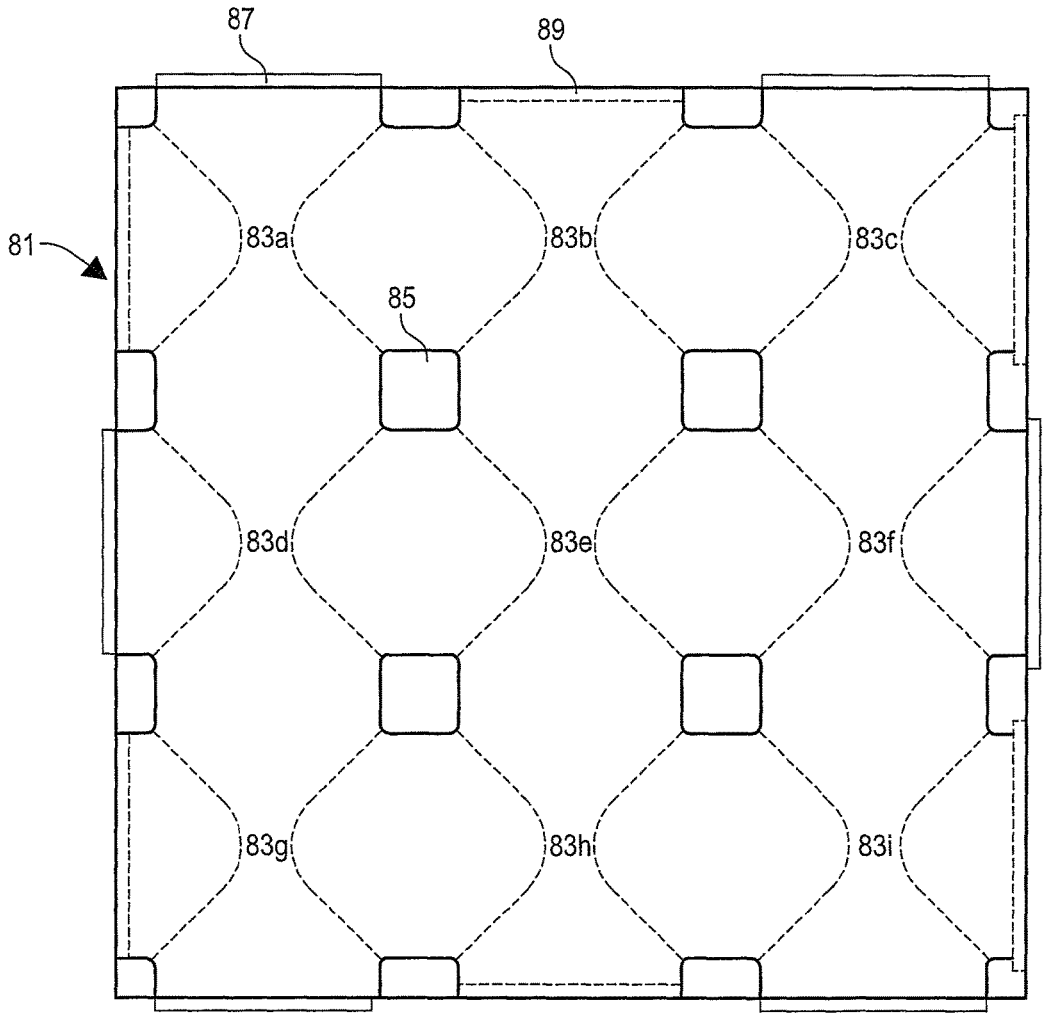

With reference to FIGS. 7 and 8, two alternative embodiments are shown to illustrate that the invention need not be limited to square tiles with 2-by-2 matrices of vaults, but can have other shapes and dimensions. FIG. 7 shows a rectangular tile 71 with a 2-by-3 matrix of vaults 73*a*-73*f* supported on the pendentives 75. FIG. 8 shows another square tile 81 with a 3-by-3 matrix of vaults 83*a*-83*i* supported on pendentives 85. In both cases, extensions 77 and 87 together with corresponding indentations 79 and 89 provide for tongue-and-groove interlocking of adjacent tiles. Other tile embodiments could have rectangular vaults characterized by different spans in the x and y axis directions. Also, while the sets of archways shown in these particular examples run in perpendicular directions, rhombic or parallelogram tiles might be used for decorative reasons with archways between the vaults being oriented at other than 90°. Triangular vaults might be used on triangular or hexagonal tiles, with sets of archways directed at 60 degree relative angles. This diversity of specific arch-tile forms provides a range of options for decorative tile layout.

What is claimed is:

1. A tile, comprising a solid rigid body having a generally flat, substantially planar upper surface, a thickness substantially less than upper surface linear dimensions, and an underside surface with a set of concavities forming a M×N matrix of vaults bounded and interconnected by archways forming paths running in two directions interconnecting the vaults where M and N are integers greater than or equal to two, the concavities also defining archways at edges of the tile body for providing paths between the tile body and any adjacent tiles, each archway characterized by a rise dimension that is less than a span dimension, the matrix of vaults defining a set of pendentives at each vault corner whose load-bearing bases are all coplanar with one another, edges of the tile body having corresponding alternating laterally projecting extensions and indentations for forming mortise-and-tenon joints between adjacent tiles.

2. A tile as in claim 1, wherein the solid rigid body has upper surface linear dimensions at least 8 times greater than the thickness measured to the pendentive bases.

3. A tile as in claim 1, wherein each vault has a span dimension at least 8 times greater than its rise dimension.

4. A tile as in claim 1, wherein the underside surface forms a two by two matrix of square vaults with archways extending laterally along 90° orthogonal axes and with four corner pendentives, four edge pendentives and one center pendentive.

5. A tile as in claim 1, wherein the vaults span at least 75% of a linear dimension across the underside surface.

6. A tile as in claim 1, wherein the extensions and indentations in edges of the tile body generally conform to archway inner curves.

7. A tile as in claim 6, wherein indentations have greater inner diameter than corresponding extension outer diameter providing leeway for engaging of mortise-and-tenon joints.

8. A tile as in claim 1, wherein the extensions and indentations in edges of the tile body are vertically elongated nodes and slots formed in edge pendentives of the tile body.

9. A tile as in claim 8, wherein slots have greater width than corresponding nodes providing leeway for engaging of mortise-and-tenon joints.

10. A tile flooring system, comprising a plurality of interconnected tiles, each tile engaging an adjacent tile by laterally projecting tenons at tile edges extending into corresponding mortise joint indentations in adjacent tile edges, each tile being a solid rigid body having a generally flat, substantially planar upper surface, a thickness substantially less than upper surface linear dimensions, and an underside surface with a set of concavities forming a M×N matrix of vaults bounded and interconnected by archways forming paths running in two directions interconnecting the vaults where M and N are integers greater or equal to two, the concavities also defining archways at edges of the tile body that provides paths between adjacent tiles, each archway characterized by a rise dimension that is less than a span dimension, the matrix of vaults defining a set of pendentives at each vault corner whose load-bearing bases are all coplanar with one another for contacting a supporting subfloor, archways of adjacent tiles being substantially aligned and tiles buttressing one another at adjacent corner and edge pendentive bases.

11. A tile as in claim 10, wherein the polygonal vaults comprise any of square, rectangular, rhombic, parallelogram, triangular, and hexagonal vaults.

12. A tile as in claim 10, wherein the M×N matrix comprises any of 2-by-2, 2-by-3, and 3-by-3 matrices.

13. A tile, comprising a solid rigid body having a generally flat, substantially planar upper surface, a thickness substantially less than upper surface linear dimensions, and an underside surface with a set of concavities forming a matrix of vaults bounded and interconnected by archways forming paths, the concavities also defining archways at edges of the tile body for providing paths between the tile body and any adjacent tiles, each archway characterized by a rise dimension that is less than a span dimension, the matrix of vaults defining a set of pendentives at each vault corner whose load-bearing bases are all coplanar with one another, edges of the tile body having corresponding alternating laterally projecting extensions and indentations for forming mortise-and-tenon joints between adjacent tiles.

14. A tile as in claim 13, wherein the underside surface forms a two by two matrix of square vaults with archways extending laterally along 90° orthogonal axes and with four corner pendentives, four edge pendentives and one center pendentive.

15. A tile as in claim 13, wherein the vaults span at least 75% of a linear dimension across the underside surface.

16. A tile as in claim 15, wherein the extensions and indentations in edges of the tile body generally conform to archway inner curves.

17. A tile as in claim 16, wherein indentations have greater inner diameter than corresponding extension outer diameter providing leeway for engaging of mortise-and-tenon joints.

18. A tile as in claim 13, wherein the extensions and indentations in edges of the tile body are vertically elongated nodes and slots formed in edge pendentives of the tile body.

19. A tile as in claim 18, wherein slots have greater width than corresponding nodes providing leeway for engaging of mortise-and-tenon joints.

20. A tile flooring system, comprising a plurality of interconnected tiles, each tile engaging an adjacent tile by laterally projecting tenons at tile edges extending into corresponding mortise joint indentations in adjacent tile edges, each tile being a solid rigid body having a generally flat, substantially planar upper surface, a thickness substantially less than upper surface linear dimensions, and an underside surface with a set of concavities forming a matrix of vaults bounded and interconnected by archways forming paths, the concavities also defining archways at edges of the tile body that provides paths between adjacent tiles, each archway characterized by a rise dimension that is less than a span dimension, the matrix of vaults defining a set of pendentives at each vault corner whose load-bearing bases are all coplanar with one another for contacting a supporting subfloor, archways of adjacent tiles being substantially aligned and tiles buttressing one another at adjacent corner and edge pendentive bases.

* * * * *